US011398341B2

(12) United States Patent
Ueda et al.

(10) Patent No.: US 11,398,341 B2
(45) Date of Patent: Jul. 26, 2022

(54) ELECTRONIC COMPONENT

(71) Applicant: Murata Manufacturing Co., Ltd., Kyoto (JP)

(72) Inventors: Yoshinori Ueda, Nagaokakyo (JP); Koshi Himeda, Nagaokakyo (JP); Hayami Kudo, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 719 days.

(21) Appl. No.: 16/170,964

(22) Filed: Oct. 25, 2018

(65) Prior Publication Data

US 2019/0066908 A1 Feb. 28, 2019

Related U.S. Application Data

(63) Continuation of application No. PCT/JP2017/000045, filed on Jan. 4, 2017.

(30) Foreign Application Priority Data

May 16, 2016 (JP) ..... JP2016-098192

(51) Int. Cl.
*H01F 27/28* (2006.01)
*H01F 27/29* (2006.01)
(Continued)

(52) U.S. Cl.
CPC ..... *H01F 27/29* (2013.01); *H01F 17/0013* (2013.01); *H01F 17/0033* (2013.01);
(Continued)

(58) Field of Classification Search
CPC ..... H01F 17/0006; H01F 17/0013; H01F 27/2804; H01F 27/29; H01F 27/292;
(Continued)

(56) References Cited

U.S. PATENT DOCUMENTS 5,515,022 A * 5/1996 Tashiro ..... H01F 17/0013 174/262
2005/0181684 A1* 8/2005 Ito ..... H05K 3/3442 439/894
(Continued)

FOREIGN PATENT DOCUMENTS

CN 1431668 A 7/2003
CN 101236837 A 8/2008
(Continued)

OTHER PUBLICATIONS

International Search Report issued in PCT/JP2017/000045; dated Apr. 4, 2017.
(Continued)

*Primary Examiner* — Tszfung J Chan
(74) *Attorney, Agent, or Firm* — Studebaker & Brackett PC

(57) ABSTRACT

An electronic component comprising a main body part including an insulating layer and a conductor layer laminated alternately. The insulating layer and the conductor layer are partially exposed on a side surface of the main body part in a direction orthogonal to a lamination direction. Also, the side surface of the main body part is provided with a metal film extending in the lamination direction to cover the insulating layer and the conductor layer exposed on the side surface.

16 Claims, 10 Drawing Sheets

(51) Int. Cl.

| | |
|---|---|
| ***H01F 17/00*** | (2006.01) |
| ***H01F 27/22*** | (2006.01) |
| ***H01F 27/32*** | (2006.01) |
| *H01F 17/04* | (2006.01) |

(52) U.S. Cl.
CPC ..... *H01F 27/22* (2013.01); *H01F 27/2804* (2013.01); *H01F 27/292* (2013.01); *H01F 27/323* (2013.01); *H01F 2017/048* (2013.01)

(58) Field of Classification Search
CPC ..... H01F 27/32; H01F 27/323; H01F 2027/2809; H01F 2027/2819; H01F 2017/002; H01F 5/003
USPC ..... 336/200, 232
See application file for complete search history.

(56) References Cited

U.S. PATENT DOCUMENTS

| | | | | |
|---|---|---|---|---|
| 2008/0100987 | A1 | 5/2008 | Togashi | |
| 2010/0157565 | A1* | 6/2010 | Yoshida | H01F 27/292 361/811 |
| 2014/0176284 | A1* | 6/2014 | Lee | H01F 27/292 336/200 |
| 2016/0104565 | A1 | 4/2016 | Nishiyama | |
| 2016/0111195 | A1 | 4/2016 | Nishyama | |
| 2017/0148562 | A1* | 5/2017 | Lee | H01F 17/0013 |
| 2017/0169930 | A1* | 6/2017 | Kudo | H01F 17/04 |
| 2017/0179913 | A1* | 6/2017 | Song | H01F 27/2804 |

FOREIGN PATENT DOCUMENTS

| | | | | |
|---|---|---|---|---|
| JP | H10335142 | A | | 12/1998 |
| JP | 2007-059539 | A | | 3/2007 |
| JP | 2007-109935 | A | | 4/2007 |
| JP | 2013-219029 | A | | 10/2013 |
| JP | 2013-219295 | A | | 10/2013 |
| JP | 2014-120759 | A | | 6/2014 |
| JP | 2014-170917 | A | | 9/2014 |
| JP | 2014-197590 | A | | 10/2014 |
| JP | 2014197590 | A | * | 10/2014 |
| JP | 2015-015297 | A | | 1/2015 |
| JP | 2015-130472 | A | | 7/2015 |
| KR | 20140137306 | A | * | 12/2014 |

OTHER PUBLICATIONS

International Preliminary Report on Patentability and Written Opinion isued in PCT/JP2017/000045; dated Nov. 20, 2018.
Office Action issued in JP 2018-518069; mailed by the Japanese Patent Office dated Jan. 8, 2019.
An Office Action; "Notification of Reasons for Refusal," Mailed by the Japanese Patent Office dated Aug. 27, 2019, which corresponds to Japanese Patent Application No. 2018-518069 and is related to U.S. Appl. No. 16/170,964; with English language translation.
An Office Action issued by the State Intellectual Property Office of the People's Republic of China dated Jun. 29, 2020, which corresponds to Chinese Patent Application No. 201780029556.5 and is related to U.S. Appl. No. 16/170,964 with English language translation.

* cited by examiner

ELECTRONIC COMPONENT

CROSS REFERENCE TO RELATED APPLICATIONS

This application claims benefit of priority to Japanese Patent Application 2016-098192 filed May 16, 2016, and to International Patent Application No. PCT/JP2017/000045 filed Jan. 4, 2017, the entire content of which is incorporated herein by reference.

BACKGROUND

Technical Field

The present disclosure relates to an electronic component.

Background Art

A conventional coil component is described as an example of an electronic component in Japanese Laid-Open Patent Publication No. 2014-197590. This electronic component has a substrate, a first conductor layer disposed on an upper surface of the substrate, a first insulating layer disposed on the first conductor layer, a second conductor layer disposed on a lower surface of the substrate, and a second insulating layer disposed under the second conductor layer. A first external electrode and a second external electrode are disposed on the first insulating layer. The first external electrode is electrically connected through a first lead-out electrode to the first conductor layer. The second external electrode is electrically connected through a second lead-out electrode to the second conductor layer.

SUMMARY

The conventional coil component is provided with conductor layers on both sides of the substrate; however, to reduce the height etc., for example, it is conceivable that multiple conductor layers and multiple insulating layers are alternately disposed on the substrate to achieve a configuration (built-up configuration) in which the conductor layers are connected through via electrodes. In this case, the insulating layers between the conductor layers have a thermal expansion coefficient higher than the conductor layers, so that interlayer peeling may occur between the conductor layers, for example, at an interface between the conductor layers and the via electrodes, due to a difference in thermal expansion coefficient caused by heat.

Therefore, the present disclosure provides an electronic component capable of reducing interlayer peeling between conductor layers.

In particular, the present disclosure provides an electronic component comprising a main body part including an insulating layer and a conductor layer laminated alternately. The insulating layer and the conductor layer are partially exposed on a side surface of the main body part in a direction orthogonal to a lamination direction. Also, the side surface of the main body part is provided with a metal film extending in the lamination direction to cover the insulating layer and the conductor layer exposed on the side surface.

The exposure includes not only exposure of the electronic component to the outside, but also exposure to another member, i.e., exposure at an interface with another member. The covering includes at least partially covering a member.

According to the electronic component, the metal film extends in the lamination direction of the insulating layer and the conductor layer and covers the insulating layer and the conductor layer on the side surface of the main body part, so that the metal film restrains the insulating layer and the conductor layer from moving in the lamination direction. Therefore, even when heat is applied to the electronic component, interlayer peeling between the conductor layers due to a difference in thermal expansion coefficient between the insulating layer and the conductor layer can be reduced.

In one embodiment of the electronic component, the electronic component has an external electrode disposed on one surface of the main body part in the lamination direction and electrically connected to the conductor layer, and the metal film is connected to the external electrode. According to the embodiment, since the metal film is connected to the external electrode and covers the insulating layer and the conductor layer on the side surface of the main body part, the metal film electrically bypasses the external electrode and the conductor layer. Therefore, electric resistance (particularly, DC electric resistance Rdc) can be reduced between the external electrode and the conductor layer.

In one embodiment of the electronic component, the main body part has a columnar electrode located between the external electrode and the conductor layer and electrically connecting the external electrode and the conductor layer. The columnar electrode is partially exposed on the side surface and the one surface of the main body part, and the metal film covers the columnar electrode exposed on the side surface.

According to the embodiment, the columnar electrode is partially exposed on the side surface and the one surface of the main body part, and the metal film covers the columnar electrode exposed on the side surface and the one surface. At the time of dicing on the side surface (cut surface) of the main body part in a manufacturing process of the electronic component, a load becomes larger when the columnar electrode is cut on the side surface of the main body part. When the load applied to the columnar electrode becomes larger, the columnar electrode may peel from the conductor layer, and the interlayer electric resistance may increase. However, the metal film covering the columnar electrode can reduce the interlayer electric resistance while reinforcing the columnar electrode against the peeling.

In one embodiment of the electronic component, the main body part has a via electrode embedded in the insulating layer and electrically connected to the conductor layer. The via electrode is partially exposed on the side surface of the main body part, and the metal film covers the via electrode exposed on the side surface.

According to the embodiment, the via electrode is partially exposed on the side surface of the main body part, and the metal film covers the via electrode exposed on the side surface. As a result, a portion of the via electrode and the metal film are connected, and the interlayer peeling due to heat can be reduced between the conductor layer and the via electrode. Particularly, even when the electronic component is reduced in size and the via electrode becomes smaller, the peeling can effectively be reduced.

In one embodiment of the electronic component, a width of the via electrode on one side in the lamination direction is smaller than a width of the via electrode on the other side in the lamination direction. According to the embodiment, a width of the via electrode on one side in the lamination direction is smaller than a width of the via electrode on the other side in the lamination direction. In this case, the interlayer peeling tends to occur on a connection surface with the conductor layer on the one side of the via electrode, so that the effect of the metal film reducing the interlayer peeling becomes more effective.

In one embodiment of the electronic component, the conductor layer is one of a plurality of conductor layers exposed on the side surface and arranged in the lamination direction. The main body part has a via electrode connecting the conductor layers adjacent to each other in the lamination direction, and the metal film connects the conductor layers adjacent to each other in the lamination direction.

According to the embodiment, since the via electrode is usually smaller and makes an area of a connection surface smaller between the conductor layer and the via electrode, the interlayer peeling tends to occur on the connection surface due to thermal expansion of the insulating layer; however, the metal film connects the conductor layers adjacent to each other in the lamination direction and therefore can reduce the interlayer peeling between the conductor layer and the via electrode due to heat.

In one embodiment of the electronic component, the conductor layers exposed on the side surface are three or more layers arranged in the lamination direction. According to the embodiment, when the conductor layers are three or more layers, the interlayer peeling is more likely to occur; however, the metal film makes the effect of reducing the interlayer peeling more effective.

In one embodiment of the electronic component, the external electrode is one of a plurality of external electrode arranged in parallel on the one surface of the main body part, the metal film is one of a plurality of metal films arranged in parallel on the side surface of the main body part, and the external electrodes are respectively connected to the metal films. According to the embodiment, the external electrode is one of a plurality of external electrode arranged in parallel on the one surface of the main body part, the metal film is one of a plurality of metal films arranged in parallel on the side surface of the main body part, and the external electrodes are respectively connected to the metal films. Such an increase in the numbers of the external electrodes and the metal films makes the connection surface of the conductor layer with the other member smaller due to restriction on the size of the electronic component so that the interlayer peeling is more likely to occur, and therefore, the effect of the metal layer reducing the interlayer peeling becomes more effective.

In one embodiment of the electronic component, the conductor layer constitutes a spiral wiring. According to the above embodiment, since the conductor layer constitutes a wiring with a narrow width, the connection surface of the conductor layer with the other member tends to be small so that the interlayer peeling is more likely to occur, and therefore, the effect of the metal layer reducing the interlayer peeling becomes more effective.

According to the electronic component of the aspect, since the side surface of the main body part is provided with the metal film extending in the lamination direction to cover the insulating layer and the conductor layer exposed on the side surface, the interlayer peeling of the conductor layer can be reduced.

DETAILED DESCRIPTION

An aspect of the present disclosure will now be described in detail with reference to shown embodiments.

First Embodiment

Figure 1:
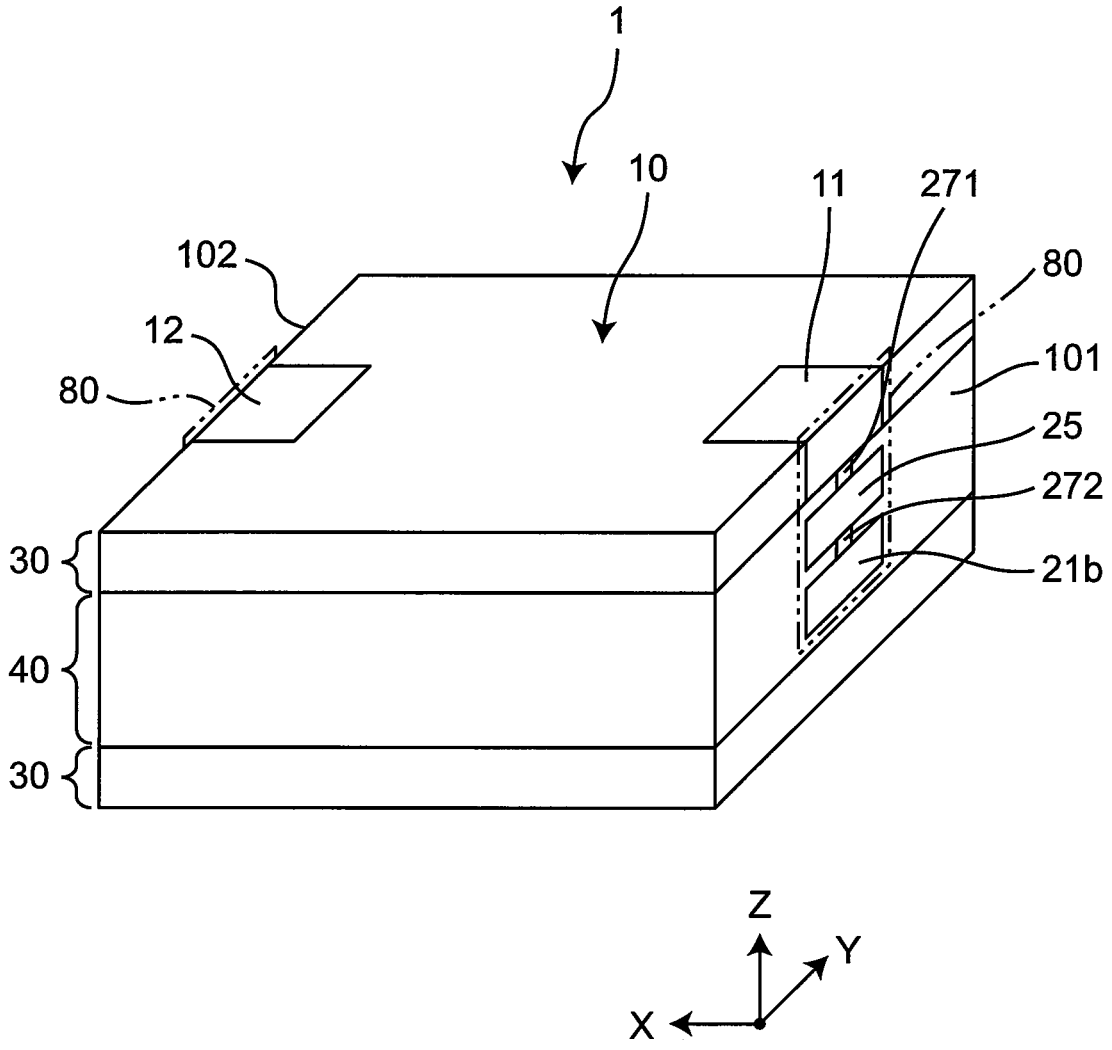
FIG. 1 is a perspective view of a first embodiment of an electronic component.
Figure 2:
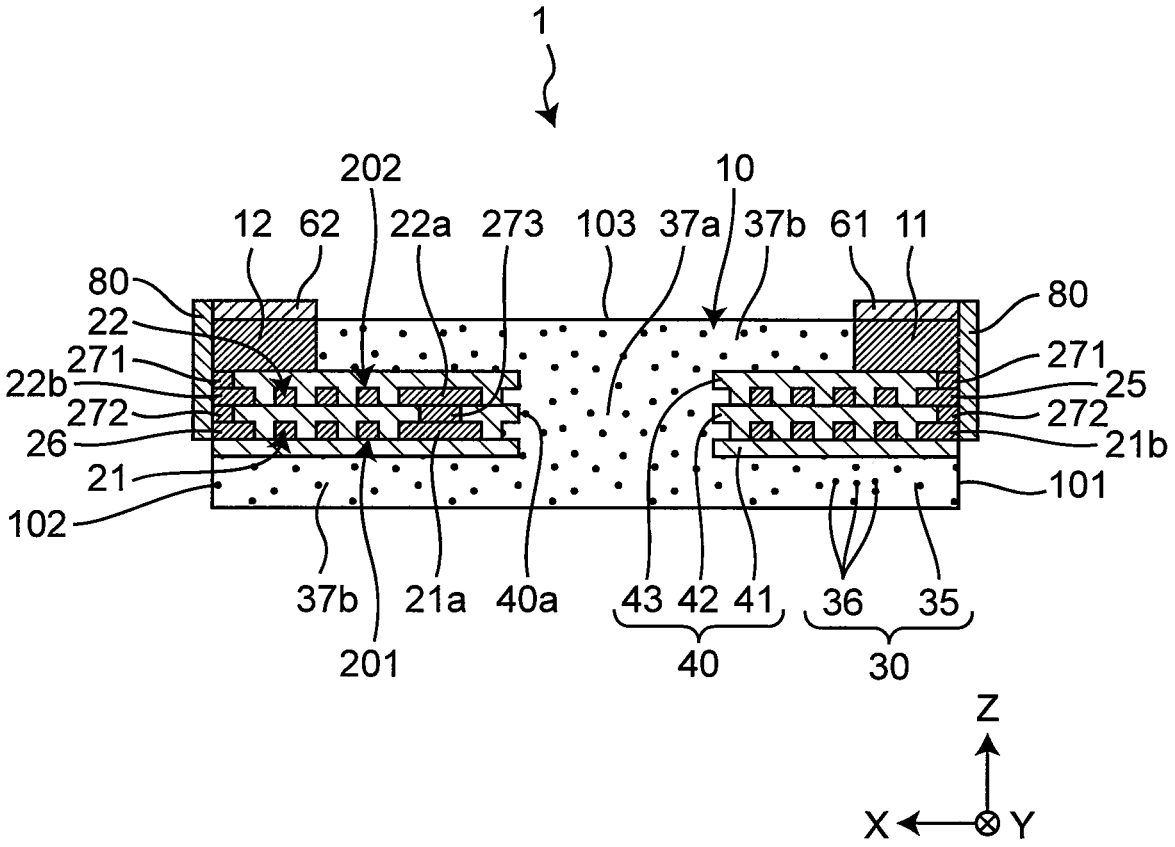
FIG. 2 is an XZ cross-sectional view of the electronic component.

FIG. 1 is a perspective view of a first embodiment of an electronic component. FIG. 2 is an XZ cross-sectional view of the electronic component. FIGS. 1 and 2 show a coil component 1 as an example of an electronic component. The coil component 1 is mounted on an electronic device such as a personal computer, a DVD player, a digital camera, a TV, a portable telephone, and automotive electronics, for example, and is a component generally having a rectangular parallelepiped shape, for example. However, the shape of the coil component 1 is not particularly limited and may be a circular columnar shape, a polygonal columnar shape, a truncated cone shape, or a truncated polygonal pyramid shape.

As shown in FIGS. 1 and 2, the coil component 1 has a main body part 10 including insulating layers 41, 42, 43 and conductor layers 201, 202 laminated alternately, and external electrodes 61, 62 disposed on one surface 103 in a lamination direction of the main body part 10 and electrically connected to the conductor layers 201, 202. The lamination direction is a stacking direction (Z direction), rather than an extending direction (XY direction), of the insulating layers 41, 42, 43 and the conductor layers 201, 202. Therefore, the first insulating layer 41, the first conductor layer 201, the second insulating layer 42, the second conductor layer 202, and the third insulating layer 43 are laminated in order in the lamination direction.

The insulating layers 41, 42, 43 and the conductor layers 201, 202 are partially exposed on side surfaces 101, 102 in a direction orthogonal to the lamination direction of the main body part 10. Metal films 80 are disposed on the side surfaces 101, 102 of the main body part 10. The metal films 80 are connected to the external electrodes 61, 62 and extend in the lamination direction to cover the insulating layers 41, 42, 43 and the conductor layers 201, 202 exposed on the side surfaces 101, 102. In FIG. 1, for clarification, the external electrodes 61, 62 are not shown, and the metal films 80 are drawn by dashed-two dotted lines.

Therefore, the metal films 80 extend in the lamination direction of the insulating layers 41, 42, 43 and the conductor layers 201, 202 and cover the insulating layers 41, 42, 43 and the conductor layers 201, 202 on the side surfaces 101, 102 of the main body part 10, so that the metal films 80 restrain the insulating layers 41, 42, 43 and the conductor layers 201, 202 from moving in the lamination direction. Therefore, even when heat is applied to the coil component 1, interlayer peeling of the conductor layers 201, 202 due to a difference in thermal expansion coefficient of the insulating layers 41, 42, 43 and the conductor layers 201, 202 can be reduced. If a conductive resin containing a metal powder is used instead of the metal film 80, the conductive resin has a thermal expansion coefficient close to that of the insulating layers 41, 42, 43 and cannot restrain the expansion and contraction of the insulating layers 41, 42, 43, so that the effect of reducing the interlayer peeling cannot be obtained.

Since the metal films 80 are connected to the external electrodes 61, 62 and cover the insulating layers 41, 42, 43 and the conductor layers 201, 202 on the side surfaces 101, 102 of the main body part 10, the metal films 80 electrically bypass the external electrodes 61, 62 and the conductor layers 201, 202. Therefore, electric resistance (particularly, DC electric resistance Rdc) can be reduced between the external electrodes 61, 62 and the conductor layers 201, 202.

Furthermore, when the external electrodes 61, 62 of the coil component 1 are mounted on a mounting substrate via solder, the solder wets up along the metal film 80 in the direction away from the external electrodes 61, 62 in the lamination direction into a fillet shape, so that the strength of the coil component 1 is improved. Therefore, the reliability of the solder connection is improved, and cracks etc. are restrained from occurring in the solder due to heat of reflow, for example.

In the coil component 1, the main body part 10 has columnar electrodes 11, 12 located between the external electrodes 61, 62 and the conductor layers 201, 202 and electrically connecting the external electrodes 61, 62 and the conductor layers 201, 202. The columnar electrodes 11, 12 are partially exposed on the side surfaces 101, 102 and the one surface 103 of the main body part 10, and the metal films 80 cover the columnar electrodes 11, 12 exposed on the side surfaces 101, 102.

At the time of dicing on the side surfaces 101, 102 (cut surfaces) of the main body part 10 in a manufacturing process of the coil component 1, a load becomes larger when the columnar electrodes 11, 12 are cut on the side surfaces 101, 102 of the main body part 10. When the load applied to the columnar electrodes 11, 12 becomes larger, the columnar electrodes 11, 12 may peel from the conductor layers 201, 202, and the interlayer electric resistance may increase. However, the metal films 80 covering the columnar electrodes 11, 12 can reduce the interlayer electric resistance while reinforcing the columnar electrodes 11, 12 against the peeling.

In the coil component 1, the main body part 10 has via electrodes 271, 272, 273 embedded in the insulating layers 42, 43 and electrically connecting the conductor layers 201, 202. The via electrodes 271, 272 are partially exposed on the side surfaces 101, 102 of the main body part 10, and the metal films 80 cover the via electrodes 271, 272 exposed on the side surfaces 101, 102.

As a result, the via electrodes 271, 272 are connected to the metal films 80, and the interlayer peeling due to heat can be reduced between the conductor layers 201, 202 and the via electrodes 271, 272. Particularly, even when the coil component 1 is reduced in size and the via electrodes 271, 272 become smaller, the peeling can effectively be reduced.

The coil component 1 will hereinafter be described in detail.

As shown in FIGS. 1 and 2, the coil component 1 has the main body part 10, the first external electrode 61 and the second external electrode 62 disposed on the one surface 103 of the main body part 10, the metal films 80 disposed on the first side surface 101 and the second side surface 102 of the main body part 10, and the first columnar electrode 11 and the second columnar electrode 12 disposed in the main body part 10 and connected to the first external electrode 61 and the second external electrode 62, respectively.

The main body part 10 is formed in a substantially rectangular parallelepiped shape and has a length, a width, and a height. The length direction of the main body part 10, the width direction of the main body part 10, and the height direction of the main body part 10 are defined as an X direction, a Y direction, and a Z direction, respectively. The first side surface 101 and the second side surface 102 are arranged in the X direction.

The main body part 10 has the first conductor layer 201 and the second conductor layer 202, an insulator 40 covering the first and second conductor layers 201, 202, and a magnetic body 30 covering the insulator 40. The insulator 40 is made up of the first insulating layer 41, the second insulating layer 42, and the third insulating layer 43. The first insulating layer 41, the first conductor layer 201, the second insulating layer 42, the second conductor layer 202, and the third insulating layer 43 are laminated in order from the lower layer to the upper layer. In this description, the upper and lower sides of the coil component 1 are described as being coincident with the upper and lower sides (in the Z direction) on the plane of FIG. 1. The Z direction coincides with the stacking direction of the layers (lamination direction).

The first conductor layer 201 includes a first spiral wiring 21. The second conductive layer 202 includes a second spiral wiring 22. The first and second spiral wirings 21, 22 are each formed into a spiral shape in a plane. For example, the first spiral wiring 21 is formed in a spiral shape turning clockwise and approaching the center when viewed from above. For example, the second spiral wiring 22 is formed in a spiral shape turning clockwise away from the center when viewed from above.

The first and second spiral wirings 21, 22 are made of low-resistance metal such as Cu, Ag, and Au, for example. Preferably, low-resistance and narrow-pitch spiral wirings can be formed by using Cu plating formed by a semi-additive method.

The first spiral wiring 21 is laminated on the first insulating layer 41. The second insulating layer 42 is laminated on the first insulating layer 41 to cover the first spiral wiring 21. The second spiral wiring 22 is laminated on the second insulating layer 42. The third insulating layer 43 is laminated on the second insulating layer 42 to cover the second spiral wiring 22. In this way, the first and second spiral wirings 21, 22 and the first to third insulating layers 41, 42, 43 are alternately laminated. In other words, the first and second spiral wirings 21, 22 are each laminated on an insulating layer and covered with an insulating layer upper than the insulating layer.

The second spiral wiring 22 is electrically connected to the first spiral wiring 21 through the third via electrode 273 extending in the lamination direction on the inner circumferential side. The third via electrode 273 is disposed in the second insulating layer 42. An inner circumferential portion 21*a* of the first spiral wiring 21 and an inner circumferential portion 22*a* of the second spiral wiring 22 are electrically connected through the third via electrode 273. As a result, the first spiral wiring 21 and the second spiral wiring 22 constitute one inductor.

An outer circumferential portion 21*b* of the first spiral wiring 21 and an outer circumferential portion 22*b* of the second spiral wiring 22 are located at both end sides of the insulator 40 when viewed in the lamination direction. The outer circumferential portion 21*b* of the first spiral wiring 21 is located on the first columnar electrode 11 side, and the outer circumferential portion 22*b* of the second spiral wiring 22 is located on the second columnar electrode 12 side.

The outer circumferential portion 21*b* of the first spiral wiring 21 is electrically connected to the first columnar electrode 11 through the second via electrode 272 on the outer circumferential side disposed in the second insulating layer 42, a first connection wiring 25 disposed on the second insulating layer 42, and the first via electrode 271 on the outer circumferential side disposed in the third insulating layer 43.

The outer circumferential portion 22*b* of the second spiral wiring 22 is electrically connected to the second columnar electrode 12 through the first via electrode 271 disposed in the third insulating layer 43. Although the outer circumferential portion 22*b* of the second spiral wiring 22 is also electrically connected to a second connection wiring 26 disposed on the first insulating layer 41 through the second via electrode 272 disposed in the second insulating layer 42, this configuration is not essential. However, by disposing and connecting the second connection wiring 26 to the outer circumferential portion 22*b*, the symmetric property in the coil component 1 can be improved to reduce variations in electrical characteristics and reliability.

The second connection wiring 26 and the first spiral wiring 21 constitute the first conductor layer 201, and the first connection wiring 25 and the second spiral wiring 22 constitute the second conductor layer 202. However, in the first conductor layer 201, the second connection wiring 26 and the first spiral wiring 21 are not electrically connected, and in the second conductor layer 202, the first connection wiring 25 and the second spiral wiring 22 are not electrically connected.

The insulator 40 is made of a composite material of an inorganic filler and a resin. The resin is an organic insulating material made of epoxy-based resin, bismaleimide, liquid crystal polymer, or polyimide, for example. The inorganic filler is an insulating layer of $SiO_2$ etc. The insulator 40 is not limited to the composite material and may be made only of a resin. The thermal expansion coefficient of the insulator 40 (the first, second, and third insulating layers 41, 42, 43) is usually 30 ppm/k or more, and also in this case, the interlayer peeling can effectively be reduced by the metal film 80. The insulator 40 has an inner diameter hole portion 40*a* inside the inner diameters of the first and second spiral wirings 21, 22.

The magnetic body 30 is made of a composite material of a resin 35 and a metal magnetic powder 36. The resin 35 is an organic insulating material made of epoxy-based resin, bismaleimide, liquid crystal polymer, or polyimide, for example. The metal magnetic powder 36 is, for example, an FeSi alloy such as FeSiCr, an FeCo alloy, an Fe alloy such as NiFe, or an amorphous alloy thereof.

The magnetic body 30 has an inner magnetic path 37*a* and an outer magnetic path 37*b*. The inner magnetic path 37*a* is located in the inner diameters of the first and second spiral wirings 21, 22 and the inner diameter hole portion 40*a* of the insulator 40. The outer magnetic path 37*b* is located above and below the first and second spiral wirings 21, 22 and the insulator 40 and is also located on the outer diameter side of the insulator 40 (not shown).

The first and second columnar electrodes 11, 12 are disposed above the first and second spiral wirings 21, 22 in the lamination direction. The first columnar electrode 11 is located on the first side surface 101 side of the main body part 10. The second columnar electrode 12 is located on the second side surface 102 side of the main body part 10. The columnar electrodes 11, 12 are made of the same material as the spiral wirings 21, 22, for example.

The first columnar electrode 11 is embedded in the magnetic body 30 of the main body part 10 such that the first columnar electrode 11 is partially exposed on the first side surface 101 and the one surface 103 of the main body part 10. The second columnar electrode 12 is embedded in the magnetic body 30 of the main body part 10 such that the second columnar electrode 12 is partially exposed on the second side surface 102 and the one face 103 of the main body part 10.

The first columnar electrode 11 is electrically connected to the first spiral wiring 21, and the second columnar electrode 12 is electrically connected to the second spiral wiring 22. The first external electrode 61 is disposed on an upper surface of the first columnar electrode 11, and the second external electrode 62 is disposed on an upper surface of the second columnar electrode 12. When the coil component 1 is mounted on a mounting substrate, the first and second external electrodes 61, 62 are connected to electrodes of the mounting substrate via solder.

On the first side surface 101 of the main body part 10, the metal film 80 is in contact with the first columnar electrode 11, the first via electrode 271, the first connection wiring 25, the second via electrode 272, and the outer circumferential portion 21*b* of the first spiral wiring 21 and is also in contact with the first external electrode 61. The metal film 80 is made of low-resistance metal such as Cu, Ag, and Au, for example. The metal film 80 is formed by electrolytic plating, electroless plating, or sputtering, for example.

Similarly, on the second side surface 102 of the main body part 10, the metal film 80 is in contact with the second columnar electrode 12, the first via electrode 271, the outer circumferential portion 22*b* of the second spiral wiring 22, the second via electrode 272, and the second connection wiring 26, and is also in contact with the second external electrode 62.

A method of manufacturing the coil component 1 will be described with reference to FIGS. 3A to 3K.

Figure 3A:
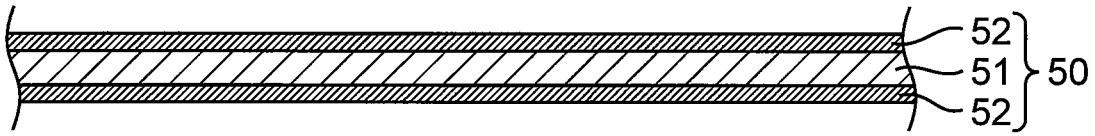
FIG. 3A is an explanatory view for explaining a method of manufacturing the electronic component.

As shown in FIG. 3A, a base 50 is prepared. In this embodiment, a plurality of the coil components 1 is manufactured from the one base 50. The base 50 has an insulating substrate 51 and base metal layers 52 disposed on both sides of the insulating substrate 51. In this embodiment, the insulating substrate 51 is a glass epoxy substrate, and the base metal layers 52 are Cu foils having upper surfaces that are smooth surfaces. Since the thickness of the base 50 does not affect the thickness of the coil component 1 because the base 50 is peeled off as described later, the base with easy-to-handle thickness may be used as needed for the reason of warpage due to processing etc.

Figure 3B:
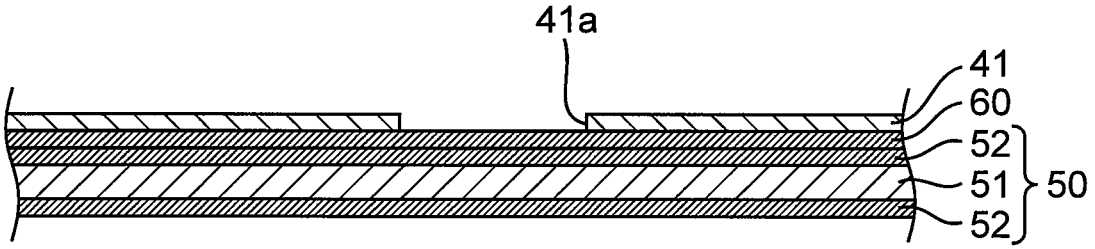
FIG. 3B is an explanatory view for explaining the method of manufacturing the electronic component.

As shown in FIG. 3B, a dummy metal layer 60 is bonded onto a surface of the base 50. In this embodiment, the dummy metal layer 60 is a Cu foil. Since the dummy metal layer 60 is bonded to the base metal layer 52 of the base 50, the dummy metal layer 60 is bonded to the smooth surface of the base metal layer 52. Therefore, an adhesion force can be made weak between the dummy metal layer 60 and the base metal layer 52 and, at a subsequent step, the base 50 can easily be peeled from the dummy metal layer 60. Preferably, an adhesive bonding the base 50 and the dummy metal layer 60 is an adhesive with low tackiness. For weakening of the adhesion force between the base 50 and the dummy metal layer 60, it is desirable that the bonding surfaces of the base 50 and the dummy metal layer 60 are glossy surfaces.

Subsequently, the first insulating layer 41 is laminated on the dummy metal layer 60 temporarily bonded to the base 50. In this case, the first insulating layer 41 is thermally press-bonded and thermally cured by a vacuum laminator, a press machine, etc. Subsequently, a central portion of the first insulating layer 41 corresponding to the inner magnetic path (magnetic core) is removed by a laser etc. to form an opening portion 41*a*.

Figure 3C:
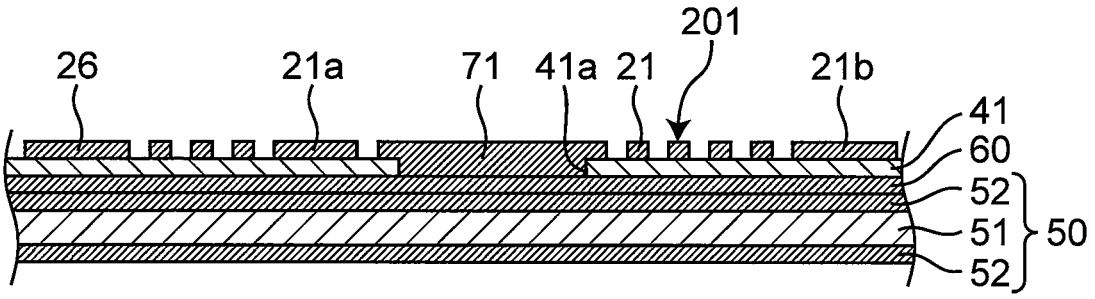
FIG. 3C is an explanatory view for explaining the method of manufacturing the electronic component.

As shown in FIG. 3C, the first spiral wiring 21 and the second connection wiring 26 are laminated as the first conductor layer 201 on the first insulating layer 41 by a semi-additive method. The first spiral wiring 21 and the second connection wiring 26 are formed not to be in contact with each other. The second connection wiring 26 is disposed on the side opposite to the outer circumferential portion 21*b*. Specifically, first, a power feeding film is formed on the first insulating layer 41 by electroless plating, sputtering, vapor deposition, etc. After the formation of the power feeding film, a photosensitive resist is applied or affixed onto the power feeding film, and a wiring pattern is formed by photolithography. Subsequently, a metal wiring corresponding to the first spiral wiring 21 and the second connection wiring 26 is formed by the electrolytic plating. After the formation of the metal wiring, the photosensitive resist is peeled and removed by a chemical liquid, and the power feeding film is etched and removed. It is noted that this metal wiring can subsequently be used as a power feeding part to acquire the wirings 21, 26 with narrower spaces by performing additional Cu electrolytic plating. A first sacrificial conductor 71 corresponding to the inner magnetic path is disposed by using the semi-additive method on the dummy metal layer 60 in the opening portion 41*a* of the first insulating layer 41.

Figure 3D:
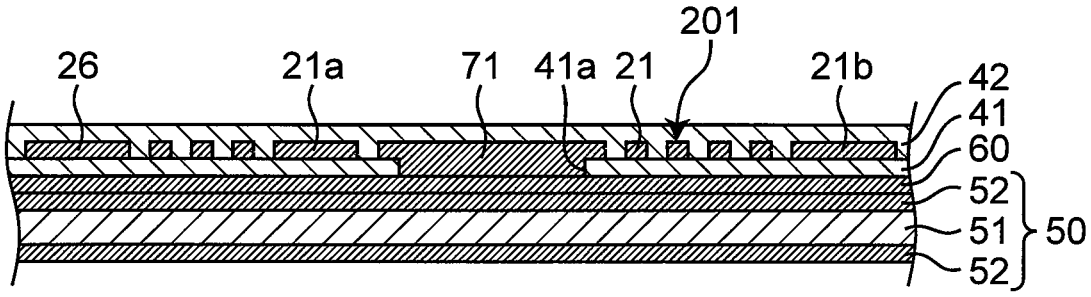
FIG. 3D is an explanatory view for explaining the method of manufacturing the electronic component.

As shown in FIG. 3D, the second insulating layer 42 is laminated on the first insulating layer 41 to cover the first spiral wiring 21, the second connection wiring 26, and the first sacrificial conductor 71 with the second insulating layer 42. The second insulating layer 42 is then thermally press-bonded and thermally cured by a vacuum laminator, a press machine, etc.

Figure 3E:
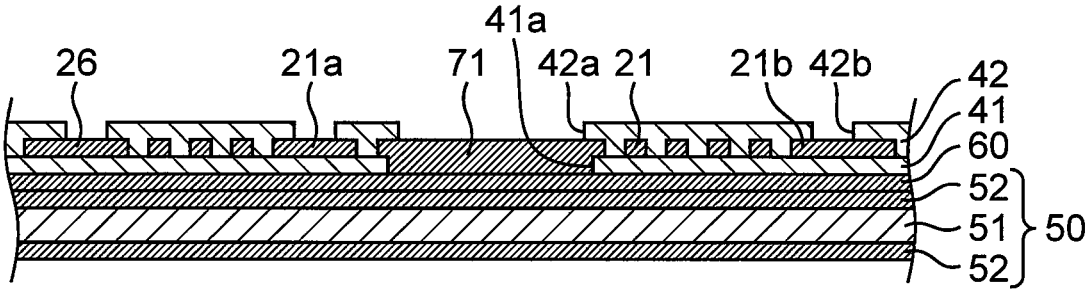
FIG. 3E is an explanatory view for explaining the method of manufacturing the electronic component.

As shown in FIG. 3E, a via hole 42*b* for filling the second via electrode 272 and the third via electrode 273 is formed in the second insulating layer 42 by laser processing etc. A portion of the second insulating layer 42 corresponding to the inner magnetic path (magnetic core) is removed by a laser etc. to form an opening portion 42*a*.

Figure 3F:
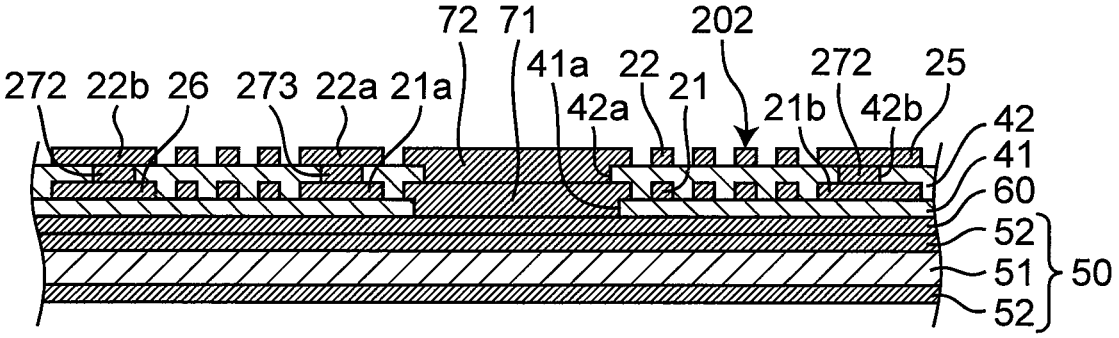
FIG. 3F is an explanatory view for explaining the method of manufacturing the electronic component.

As shown in FIG. 3F, the second via electrode 272 and the third via electrode 273 are filled in the via hole, and the second spiral wiring 22 and the first connection wiring 25 are laminated on the second insulating layer 42 as the second conductor layer 202. The second spiral wiring 22 and the first connection wiring 25 are formed not to be in contact with each other. The first connection wiring 25 is disposed on the side opposite to the outer circumferential portion 22*b*. A second sacrificial conductor 72 corresponding to the inner magnetic path is disposed on the first sacrificial conductor 71 in the opening portion 42*a* of the second insulating layer 42. In this case, the second via electrode 272, the third via electrode 273, the second spiral wiring 22, the first connection wiring 25, and the second sacrificial conductor 72 can be disposed by the same process as the first spiral wiring 21, the second connection wiring 26, and the first sacrificial conductor 71.

Figure 3G:
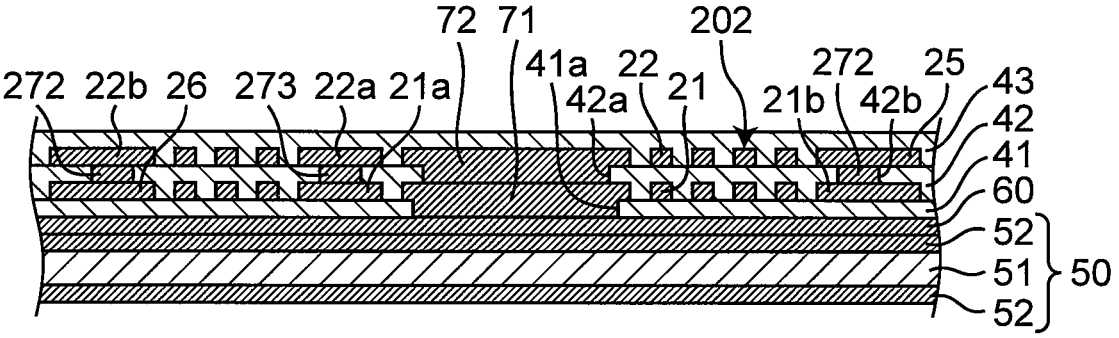
FIG. 3G is an explanatory view for explaining the method of manufacturing the electronic component.

As shown in FIG. 3G, the third insulating layer 43 is laminated on the second insulating layer 42 to cover the second spiral wiring 22, the first connection wiring 25, and the second sacrificial conductor 72 with the third insulating layer 43. The third insulating layer 43 is thermally press-bonded and thermally cured by a vacuum laminator, a press machine, etc.

Figure 3H:
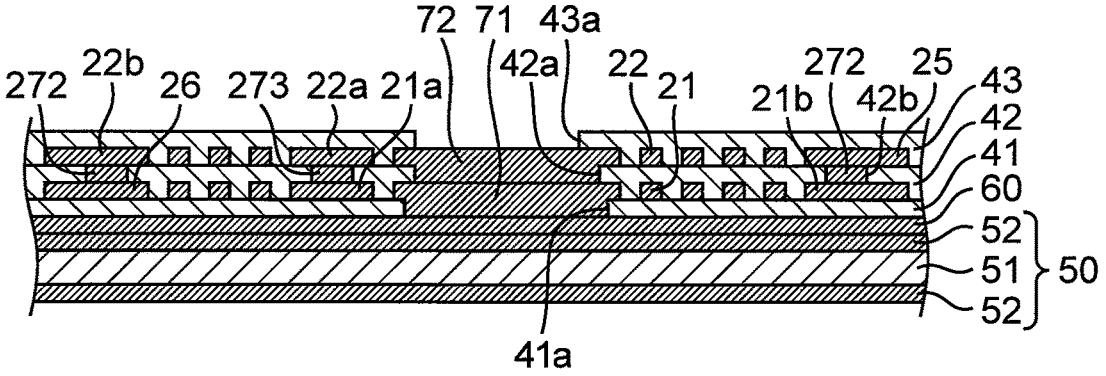
FIG. 3H is an explanatory view for explaining the method of manufacturing the electronic component.

As shown in FIG. 3H, a portion of the third insulating layer 43 corresponding to the inner magnetic path (magnetic core) is removed by a laser etc. to form an opening portion 43*a*.

Figure 3I:
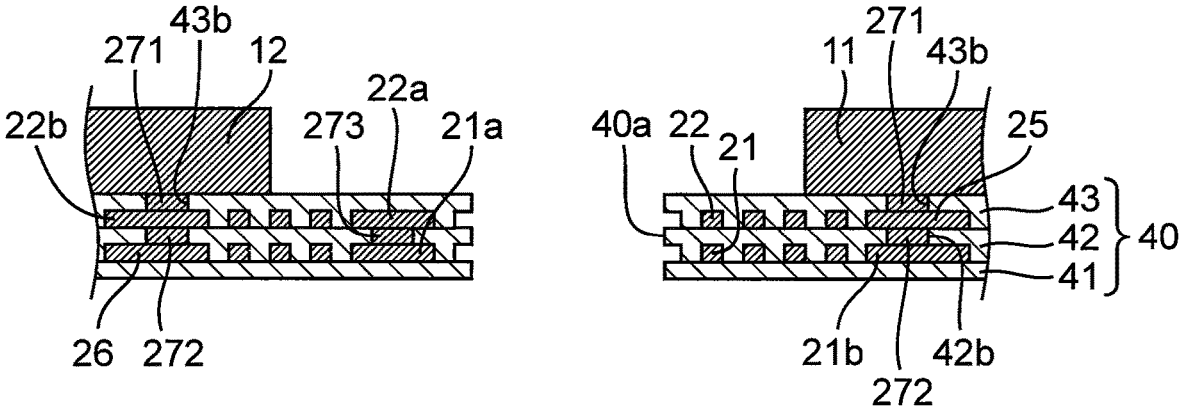
FIG. 3I is an explanatory view for explaining the method of manufacturing the electronic component.

Subsequently, the base 50 is peeled off from the dummy metal layer 60 on the bonding plane between the surface of the base 50 (the base metal layer 52) and the dummy metal layer 60. The dummy metal layer 60 is removed by etching etc. In this process, the first and second sacrificial conductors 71, 72 are removed by etching etc., and as shown in FIG. 3I, the inner diameter hole portion 40*a* corresponding to the inner magnetic path is disposed in the insulator 40. Subsequently, a via hole 43*b* for filling the first via electrode 271 is formed in the third insulating layer 43 by laser processing etc. The first via electrode 271 is filled in the via hole 43*b*, and the first and second columnar electrodes 11, 12 having a columnar shape are laminated on the third insulating layer 43. In this case, the first via electrode 271 and the first and second columnar electrodes 11, 12 can be disposed by the same process as the first spiral wiring 21.

Figure 3J:
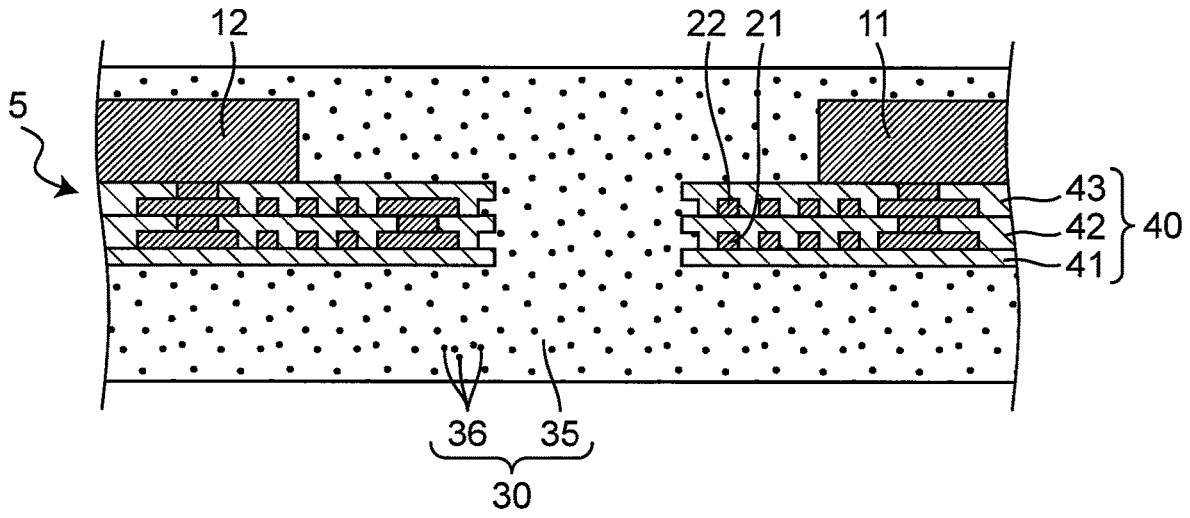
FIG. 3J is an explanatory view for explaining the method of manufacturing the electronic component.

As shown in FIG. 3J, the first and second columnar electrodes 11, 12 as well as the upper and lower surface sides of the insulator 40 are covered with the magnetic body 30 and the magnetic body 30 is thermally press-bonded and thermally cured by a vacuum laminator, a press machine, etc. to form a coil substrate 5. In this case, the magnetic body 30 is also filled into the hole portion 40*a* of the insulator 40.

Figure 3K:
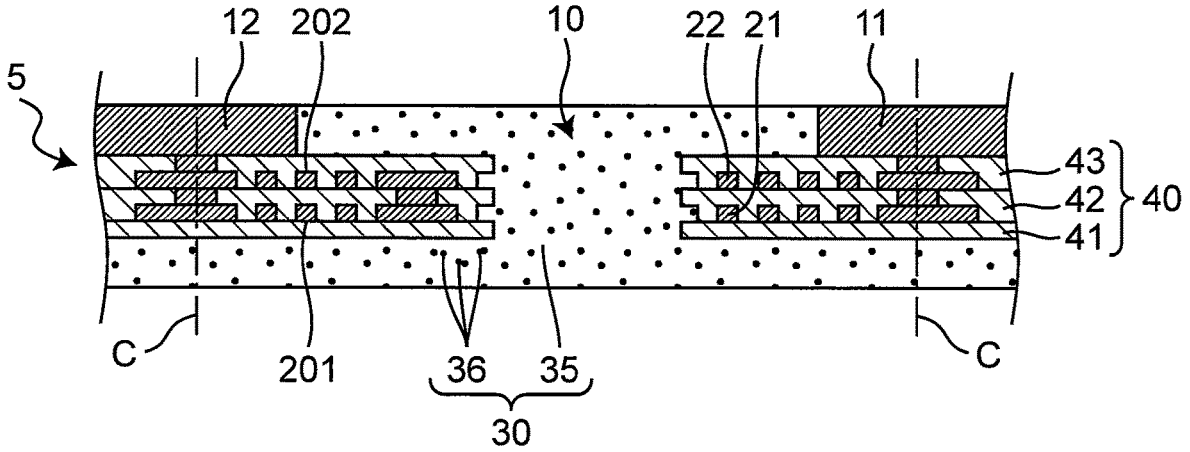
FIG. 3K is an explanatory view for explaining the method of manufacturing the electronic component.

As shown in FIG. 3K, the magnetic body 30 on the upper and lower sides of the coil substrate 5 is reduced in thickness by a grinding method. In this case, the first and second columnar electrodes 11, 12 are partially exposed so that the upper end surfaces of the first and second columnar electrodes 11, 12 are located on the same plane as the upper end surface of the magnetic body 30. The first and second external terminals 61, 62 (see FIG. 2) are then disposed on the upper end surfaces of the first and second columnar electrodes 11, 12.

Subsequently, the coil substrate 5 (the main body part 10) is diced or scribed into pieces along cut surfaces C. In this case, the cut surfaces C constitute the first and second end surfaces 101, 102 of the main body part 10. Therefore, the first columnar electrode 11, the first via electrode 271, the first connection wiring 25, the second via electrode 272, and the outer circumferential portion 21*b* of the first spiral wiring 21 are exposed from the first end surface 101 of the main body part 10. The second columnar electrode 12, the first via electrode 271, the outer circumferential portion 22*b* of the second spiral wiring 22, the second via electrode 272, and the second connection wiring 26 are exposed from the second end surface 102 of the element body 10.

Subsequently, the metal films 80 (see FIG. 2) are disposed on the first and second side surfaces 101, 102 of the main body part 10. The metal films 80 are formed by Cu plating treatment, for example. This plating treatment may be either electroless plating or electrolytic plating. As a result, on the first side surface 101, the metal film 80 covers the first external electrode 61, the first columnar electrode 11, the first via electrode 271, the first connection wiring 25, the second via electrode 272, and the outer circumferential portion 21*b* of the first spiral wiring 21. On the second side surface 102, the metal film 80 covers the second external electrode 62, the second columnar electrode 12, the first via electrode 271, the outer circumferential portion 22*b* of the second spiral wiring 22, the second via electrode 272, and the second connection wiring 26. In this way, the coil component 1 shown in FIG. 2 is formed.

Although the coil substrate 5 is formed on one of both surfaces of the base 50 in the manufacturing method described above, the coil substrate 5 may be formed on each of both surfaces of the substrate 50. Alternatively, pluralities of the first and second spiral wirings 21, 22 and the insulators 40 may be formed in parallel on one surface of the base 50 and may be divided into pieces so that a multiplicity of the coil substrates 5 can be formed at the same time. As a result, a plurality of the coil components 1 can be formed at the same time by using the one base 50, and higher productivity can be achieved.

Second Embodiment

Figure 4:
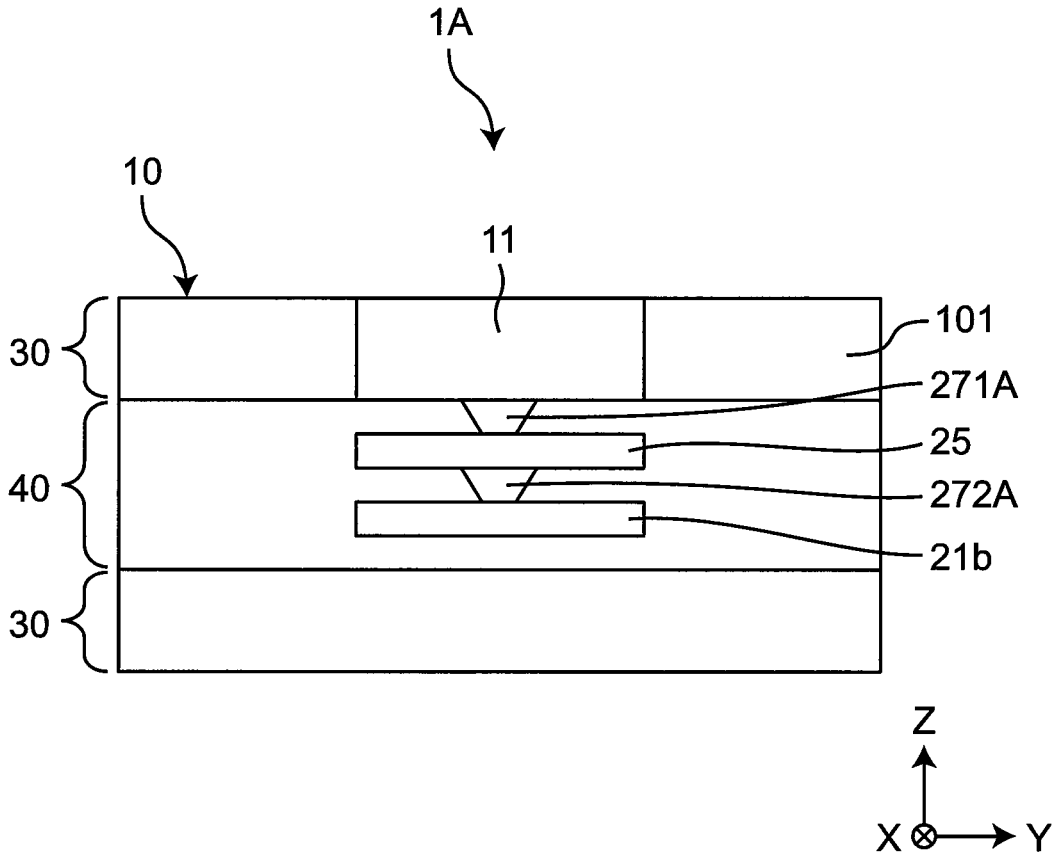
FIG. 4 is a view on X-direction arrow of a second embodiment of an electronic component.

FIG. 4 is a view on X-direction arrow of a second embodiment of an electronic component of the present disclosure. The second embodiment is different from the first embodiment in the configuration of the via electrodes. This different configuration will hereinafter be described. In the second embodiment, the same constituent elements as the first embodiment are denoted by the same reference numerals as the first embodiment and therefore will not be described.

As shown in FIG. 4, in a coil component 1A serving as the electronic component, a width of a first via electrode 271A on one side in the lamination direction is smaller than a width of the first via electrode 271A on the other side in the lamination direction. Specifically, a width of a lower end (the lower side in the Z direction) of the first via electrode 271A is smaller than a width of an upper end (the upper side in the Z direction) of the first via electrode 271A. Therefore, the shape of the first via electrode 271A is a trapezoid when viewed in the X direction. In this case, due to a relationship of contact area, the interlayer peeling tends to occur on a connection surface with the first connection wiring 25 on the lower end side (one side) of the first via electrode 271A.

Therefore, this configuration allows the metal film 80 to more effectively exert the interlayer peeling reduction effect. A second via electrode 272A has the same configuration as the first via electrode 271A. The second side surface 102 has the same configuration as the first side surface 101.

The width of the upper end of the first via electrode may be smaller than the width of the lower end of the first via electrode. At least one of the first and second via electrodes may have the configuration described above.

Third Embodiment

Figure 5:
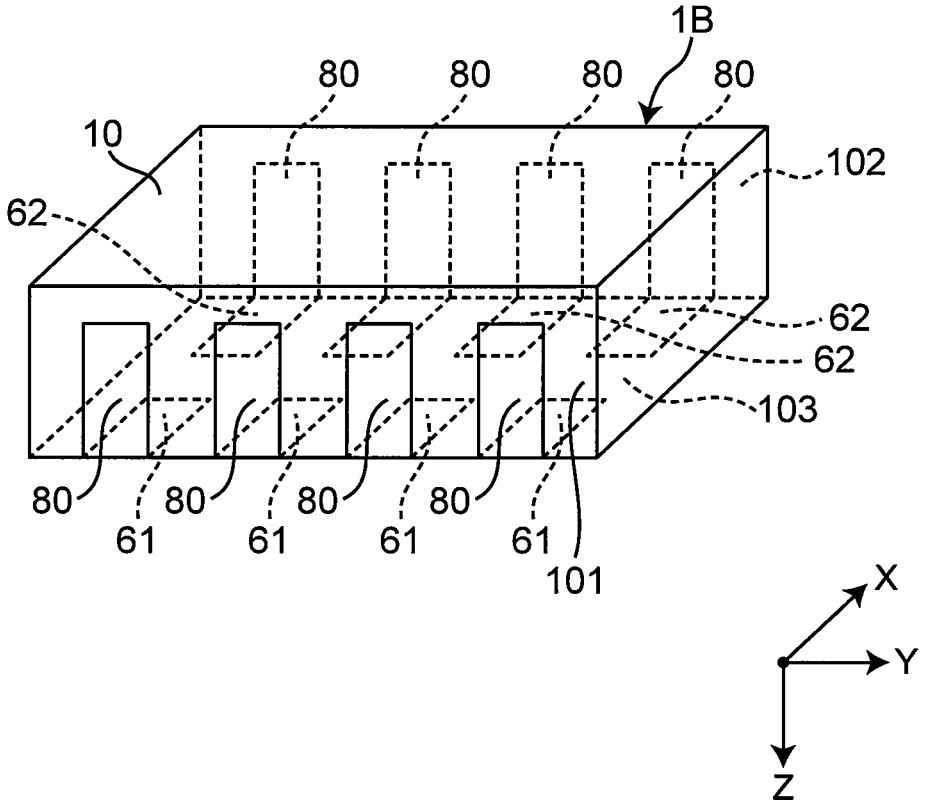
FIG. 5 is a perspective view of a third embodiment of an electronic component.

FIG. 5 is a perspective view of a third embodiment of an electronic component of the present disclosure. The third embodiment is different from the first embodiment in the numbers of external electrodes and metal films. This different configuration will hereinafter be described. In the third embodiment, the same constituent elements as the first embodiment are denoted by the same reference numerals as the first embodiment and therefore will not be described.

As shown in FIG. 5, in a coil component 1B serving as the electronic component, the multiple (in this embodiment, four) first external electrodes 61 are arranged in parallel along the Y direction on the one surface 103 of the main body part 10. The multiple (in this embodiment, four) metal films 80 are arranged in parallel along the Y direction on the first side surface 101 of the main body part 10. The first external electrodes 61 are respectively connected to the metal films 80.

Similarly, the multiple (in this embodiment, four) second external electrodes 62 are arranged in parallel along the Y direction on the one surface 103 of the main body part 10. The multiple (in this embodiment, four) metal films 80 are arranged in parallel along the Y direction on the second side surface 102 of the main body part 10. The second external electrodes 62 are respectively connected to the metal films 80.

Such an increase in the numbers of the first and second external electrodes 61, 62 and the metal films 80 makes the columnar electrodes 11, 12, the spiral wirings 21, 22, the via electrode 271, 272, and the connection wirings 25, 26 smaller due to restriction on the size of the coil component 1.

However, as described in the first embodiment, the metal films 80 cover the columnar electrodes 11, 12, the spiral wirings 21, 22, the via electrodes 271, 272, and the connection wirings 25, 26 and therefore can effectively reduce the interlayer peeling thereof.

The present disclosure is not limited to the embodiments described above and may be changed in design without departing from the spirit of the present disclosure. For example, respective feature points of the first to third embodiments may variously be combined.

Although the metal film and the external electrode are separate members in the first embodiment, the metal film and the external electrode may be the same member (integrated). Although the columnar electrodes are disposed in the first embodiment, the columnar electrodes may not be included.

Although the columnar electrodes and the via electrodes are exposed on the side surfaces in the first embodiment, only the conductor layers may be exposed on the side surfaces without exposing the columnar electrodes and the via electrodes on the side surfaces. In this case, the metal film is formed by plating from the conductor layers on both sides of the insulating layer, extending over the insulating layer. Consequently, the metal film covers the insulating layer between the conductor layers. Therefore, the via electrode may be covered with the insulating layer without being exposed on the side surface of the main body part. In this case, the multiple conductor layers are exposed on the side surface in the lamination direction, and the main body part is configured to have the via electrode connecting the conductor layers adjacent to each other in the lamination direction while the metal film connects the conductor layers adjacent to each other. If the metal film is not included, since the via electrode is usually smaller than the conductor layer and makes an area of a connection surface smaller between the conductor layer and the via electrode, the interlayer peeling tends to occur on the connection surface due to thermal expansion of the insulating layer. On the other hand, in the configuration described above, the metal film connects the conductor layers adjacent to each other in the lamination direction and therefore restrains the expansion and contraction of the insulating layer due to heat between the conductor layers. Therefore, even in the configuration without exposing the via electrode on the side surface of the main body part, i.e., the configuration without contact between the metal film and the via electrode, the interlayer peeling can be reduced between the conductor layer and the via electrode.

Although the configuration including the metal film, the columnar electrode, and the trapezoidal via electrode is described in the second embodiment, the configuration may include only the metal film and the trapezoidal via electrode.

Although the configuration including the multiple metal films, the multiple external electrodes, the columnar electrode, and the via electrode is described in the third embodiment, the configuration may include only the multiple metal films and the multiple external electrodes.

Although two layers of the spiral wirings are included in the first embodiment, three or more layers of the spiral wirings may be included. In other words, although two conductor layers are included, three or more conductor layers may be included, and when three or more conductor layers are included, the increased number of laminated insulation layers makes the expansion and contraction due to heat larger so that the interlayer peeling is more likely to occur, and therefore, the effect of the metal layer reducing the interlayer peeling becomes more effective. Although three insulating layers are included, four or more insulating layers may be included.

Although the electronic component is a coil component in the first embodiment, the electronic component may be a capacitor etc. In the case of a coil component, since the conductor layer constitutes a helical wiring, i.e., a wiring with a narrow width, the connection surface of the conductor layer with the other member tends to be small so that the interlayer peeling is more likely to occur, and therefore, the effect of the metal layer reducing the interlayer peeling becomes more effective.

EXAMPLE

An example of the first embodiment will be described.

Figure 6A:
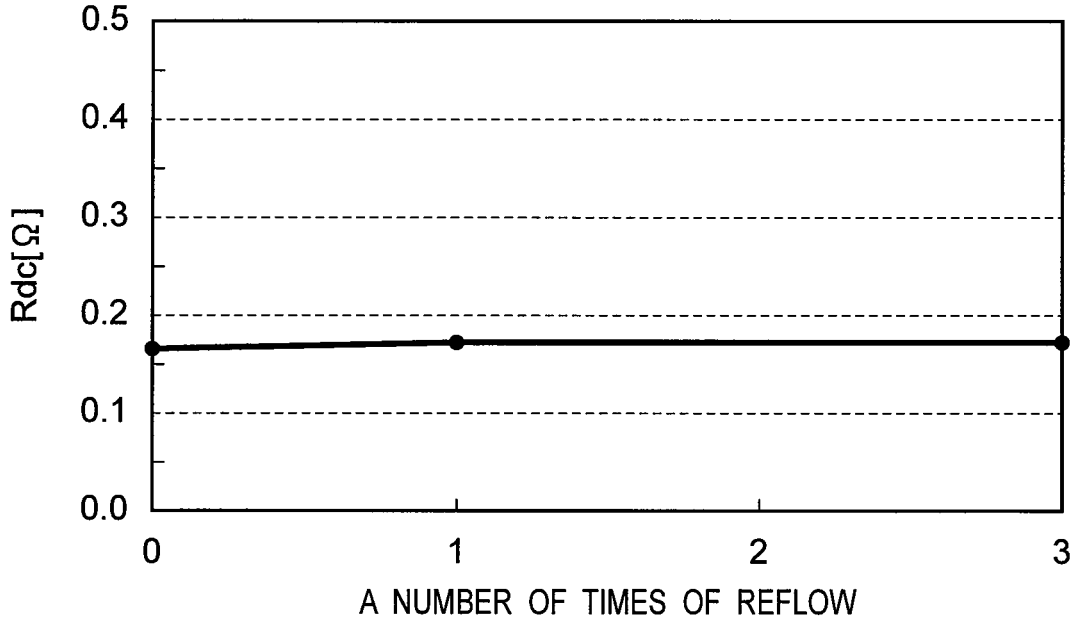
FIG. 6A is a graph of a relationship between the number of times of reflow and electric resistance in an example.

FIG. 6A shows a relationship between the number of times of reflow and DC electric resistance Rdc of a coil component that is an example of the first embodiment at the time of mounting on a mounting substrate via solder. The DC electric resistance Rdc was measured as a DC electric resistance value (in Ω) between external electrodes (between the external electrodes 61, 62 in the coil component 1). As shown in FIG. 6A, in the example, the DC electric resistance Rdc was almost unchanged before and after the reflow.

Figure 6B:
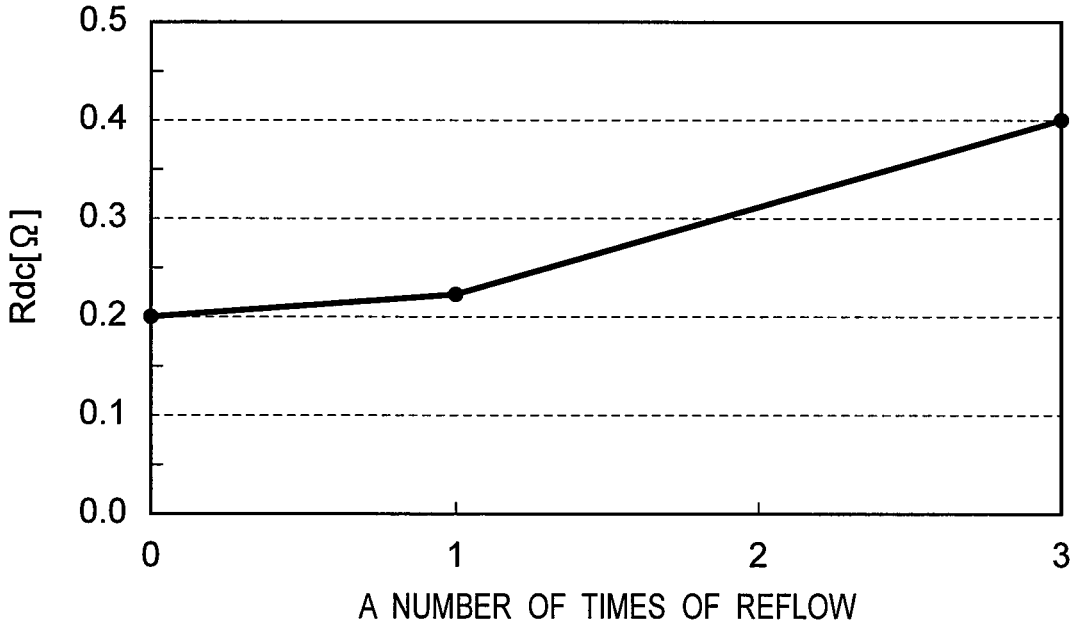
FIG. 6B is a graph of a relationship between the number of times of reflow and electric resistance in a comparative example.

FIG. 6B shows a relationship between the number of times of reflow and the DC electric resistance Rdc of a coil component without the metal film that is a comparative example of the first embodiment. The measurement method of the DC electric resistance Rdc was the same as FIG. 6A. As shown in FIG. 6B, in the comparative example, the DC electric resistance Rdc increased before and after the reflow. This means the occurrence of the interlayer peeling between the conductor layers due to heat during the reflow.

As described above, in the example in which the metal film is disposed, the interlayer peeling between the conductor layers can be reduced. In the example, additionally, the DC electric resistance Rdc before the reflow was low as compared to the comparative example. It is considered that the DC electric resistance Rdc becomes smaller since a path going through the metal film is formed between the external electrode and the conductor layer in the example and this path does not pass through the interface, in which the DC electric resistance Rdc tends to be high, between the conductor layer and the via electrode. Therefore, the configuration of the example also has an effect of reducing the DC electric resistance between the external electrode and the conductor layer.

What is claimed is:

1. An electronic component comprising:

a main body part including an insulating layer and a plurality of conductor layers laminated alternately, and at least one external electrode disposed on one surface of the main body part in the lamination direction and electrically connected to the plurality of conductor layers, wherein the plurality of conductor layers are connected by a via electrode, and extend in a lamination direction of the main body part, to form a single inductor, the insulating layer, the conductor layers, and the via electrode are each partially exposed on a side surface of the main body part in a direction orthogonal to the lamination direction, and the side surface of the main body part is provided with a metal film extending in the lamination direction to cover a side surface of the at least one external electrode, the insulating layer, the via electrode, and the conductor layers exposed on the side surface.

2. The electronic component according to claim 1, wherein the metal film is connected to the external electrode.

3. The electronic component according to claim 2, wherein the main body part has a columnar electrode located between the external electrode and one of the plurality of conductor layers and electrically connecting the external electrode and the one of the plurality of conductor layers, the columnar electrode is partially exposed on the side surface and the one surface of the main body part, and the metal film covers the columnar electrode exposed on the side surface.

4. The electronic component according to claim 1, wherein a width of the via electrode on one side in the lamination direction is smaller than a width of the via electrode on the other side in the lamination direction.

5. The electronic component according to claim 1, wherein the metal film connects conductor layers adjacent to each other in the lamination direction.

6. The electronic component according to claim 5, wherein the conductor layers exposed on the side surface are three or more layers arranged in the lamination direction.

7. The electronic component according to claim 2, wherein the external electrode is one of a plurality of external electrodes arranged in parallel on the one surface of the main body part, the metal film is one of a plurality of metal films arranged in parallel on the side surface of the main body part, and the external electrodes are respectively connected to the metal films.

8. The electronic component according to claim 1, wherein the plurality of conductor layers constitute a spiral wiring.

9. The electronic component according to claim 2, wherein the metal film connects conductor layers adjacent to each other in the lamination direction.

10. The electronic component according to claim 3, wherein the metal film connects conductor layers adjacent to each other in the lamination direction.

11. The electronic component according to claim 2, wherein the plurality of conductor layers constitute a spiral wiring.

12. The electronic component according to claim 3, wherein the plurality of conductor layers constitute a spiral wiring.

13. The electronic component according to claim 4, wherein the plurality of conductor layers constitute a spiral wiring.

14. The electronic component according to claim 5, wherein the plurality of conductor layers constitute a spiral wiring.

15. The electronic component according to claim 6, wherein the plurality of conductor layers constitute a spiral wiring.

16. The electronic component according to claim 7, wherein the plurality of conductor layers constitute a spiral wiring.

* * * * *